US005816928A

United States Patent [19]

Colonna

[11] Patent Number: 5,816,928

[45] Date of Patent: Oct. 6, 1998

[54] GOLF PUTTING PRACTICE APPARATUS

[76] Inventor: John P. Colonna, 7550 Fairway Woods Dr., Sarasota, Fla. 34238

[21] Appl. No.: 815,051

[22] Filed: Mar. 11, 1997

Related U.S. Application Data

[63] Continuation-in-part of Ser. No. 591,152, Jan. 25, 1996, abandoned.

[51] Int. Cl.[6] ..... A63B 69/56

[52] U.S. Cl. ..... 473/229; 473/258

[58] Field of Search ..... 473/257, 229, 473/219, 226, 227, 231, 258, 260

[56] References Cited

U.S. PATENT DOCUMENTS

| | | | |
|---|---|---|---|
| 1,137,349 | 4/1915 | Patterson . | |
| 2,858,133 | 10/1958 | Self | 273/186 |
| 2,869,875 | 1/1959 | Steenson | 273/177 |
| 3,073,602 | 1/1963 | Bell | 273/186 |
| 3,232,623 | 2/1966 | Abrams et al. | 273/186 |
| 3,804,420 | 4/1974 | Boyd | 273/183 |
| 4,135,714 | 1/1979 | Hughes | 272/136 |
| 4,353,556 | 10/1982 | Self et al. | 273/186 |
| 4,535,991 | 8/1985 | Boatright | 273/193 |
| 4,944,518 | 7/1990 | Flynn | 273/186 |
| 4,984,802 | 1/1991 | Barraclough | 273/192 |
| 5,022,656 | 6/1991 | Tiller | 273/186 |

*Primary Examiner*—Mark S. Graham
*Attorney, Agent, or Firm*—C. Douglas McDonald, Jr. & Associates P.A.

[57] ABSTRACT

The golf putting practice apparatus of this invention includes a base having a bias element attached thereto and a flexible connecting element connected between the bias element and an attachment assembly, which may be releasably attached to a putter. The bias element provides tension to the connecting element in order to maintain the portion of the connecting element extending between attachment assembly and the bias element taut, thereby providing a substantially linear alignment reference along which an individual may traverse the putter.

15 Claims, 3 Drawing Sheets

GOLF PUTTING PRACTICE APPARATUS

RELATED APPLICATION

This application is a continuation-in-part of application Ser. No. 08 591,152 filed Jan. 25, 1996, entitled Golf Putting Practice Apparatus, and now abandoned.

BACKGROUND OF THE INVENTION

The present invention relates generally to a golf putting practice apparatus primarily intended to train a golfer to swing a putter linearly for aligning an individual's putter with a golf ball and hitting the golf ball toward a target.

It is well known that a common denominator for obtaining a low golf score is consistently accurate putting. While numerous putting alignment devices have been proposed, none appear to completely satisfy an individual's need for developing an effective putting stroke.

In general, a proper putting stroke includes moving the golf club along a substantially linear path defined by the desired trajectory of the golf ball, such that then "sweet spot" of the putter strikes the ball. In addition, the putter may traverse over the linear path in a generally pendulum-like motion. Perhaps one of the most significant components of the putting stroke is the follow through, where the putter preferably travels over a substantially straight line generally impacting the ball along its intended initial path. Even in circumstances where there may be a significant break or angle of pitch on a green, one still aims toward a point where one believes that the green will break and cause the golf ball to go into the hole or strike the target.

Another important component of a proper putting stroke is connecting the "sweet-spot" of the putter to the diametrical center of the ball along a line that is generally linear with the initial desired path of the ball. This is succeeded by a follow through over the same line. On a substantially flat putting surface, one need not account for any break and may, thus, aim straight for the hole by swinging the putter such that the "sweet-spot" connects the center of the ball, traversing over substantial linear line extending between the ball and the intended target.

In view of the foregoing, it is desired to provide a relatively simple and inexpensive apparatus that may improve an individual's putting stroke, and thereby enhance that individual's overall golf game. It is also desired to provide a versatile apparatus that may be used on substantially any putting surface, including indoors or outdoors. It is still further desired to provide a visual guide to which an individual may align a putter and putt with a proper follow through. It is still further desired to provide an alignment apparatus that is substantially unobtrusive to an individual's putting stroke. It is also desired to provide an apparatus that may be used to align a putting stroke to substantially any target that may be selected by a golfer at a reasonable distance.

SUMMARY OF THE INVENTION

In view of the foregoing objects and others that will become apparent, the present invention is directed to a golf putting apparatus primarily intended to train a golfer to move a putter having a shaft linearly for putting a golf ball positioned upon a putting surface toward a target. The invention includes a base that is removably connected to a predetermined location on the putting surface with a bias element attached to the base. An elongated connecting element has two ends. A first end of the connecting element is connected to the bias element such that the bias element provides tension to the connecting element. A putter attachment assembly that is releasably attachable to a putter is connected to a second end of the connecting element. The attachment assembly is moveable away from the bias element a varying distance up to the length of the connecting element, with the tension from the bias element maintaining the length of the connecting element extending between the attachment assembly and the bias element taut.

BRIEF DESCRIPTION OF THE DRAWINGS

For a more full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
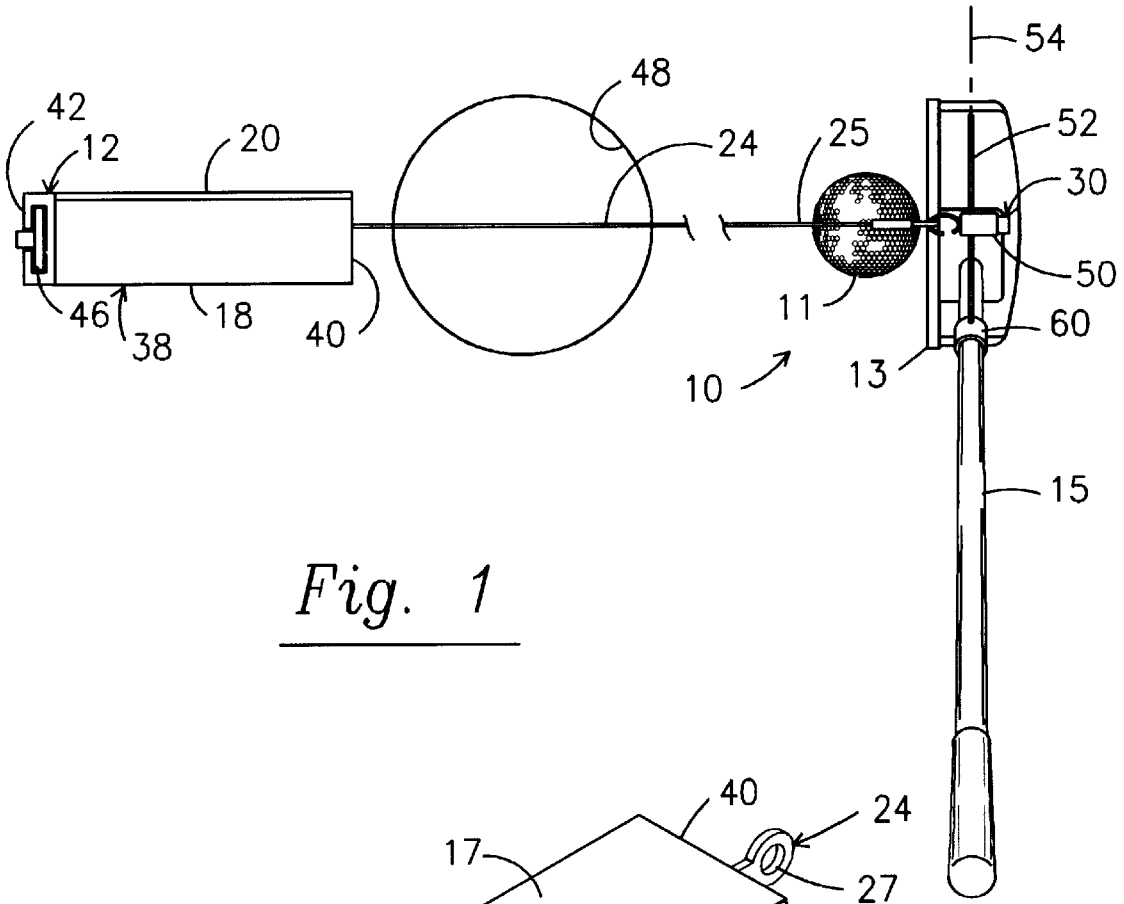
FIG. 1 is a top view of a preferred embodiment of the apparatus of the present invention shown in positioned proximal a golf hole.

Referring to the FIG. 1, the golf putting practice apparatus of the present invention, generally indicated as 10, is shown in a typical context, being positioned upon a putting surface 14, which may suitably be a putting green when used outdoors or a standard household flooring, such as carpet, wood or tile, when used indoors. In general, the apparatus 10 includes a base 12 that is removably positionable at predetermined location on the putting surface 14, which may be grass, carpet or any other surface, such that when positioned thereupon the bottom of the base 16 engages the surface to resist sliding or movement of the base 12 generally parallel to surface 14. Apparatus 10 also includes a bias element 22 that is attached to the base 12 and an elongated flexible connecting element 24 connected between the bias element 22 and a putter attachment assembly 30, suitably releasably attached to a putter, generally indicated as 13. These component parts cooperate to train a golfer to move the putter 13 over a linear path established by the bias element 22 providing a relatively small amount tension to the connecting element 24 that extends between the attachment assembly 30, which may be attached to putter shaft 15, and the bias element 22. As the attachment assembly is moved toward or away from base 14, the engagement between base bottom 16 and the surface 14 maintains the base in a substantially fixed position with respect to surface 14, although easily removable by the user. As shown in FIG. 1, this tension maintains the connecting element 24 taut, thereby providing a visual reference that is proximal to and generally parallel to the putting surface 14 for the alignment of the putter, a golf ball 11 and a target, suitably a hole 48.

Figure 2:
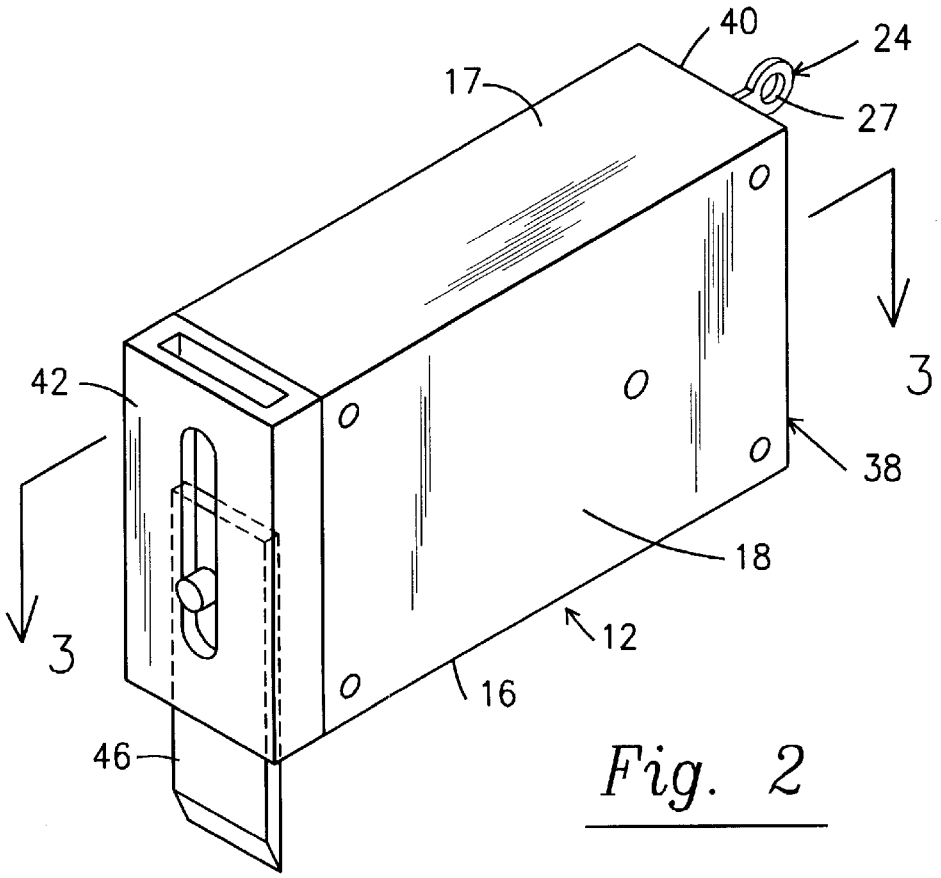
FIG. 2 is a perspective view of the base portion of the apparatus of FIG. 1 with the attachment assembly removed.
Figure 3:
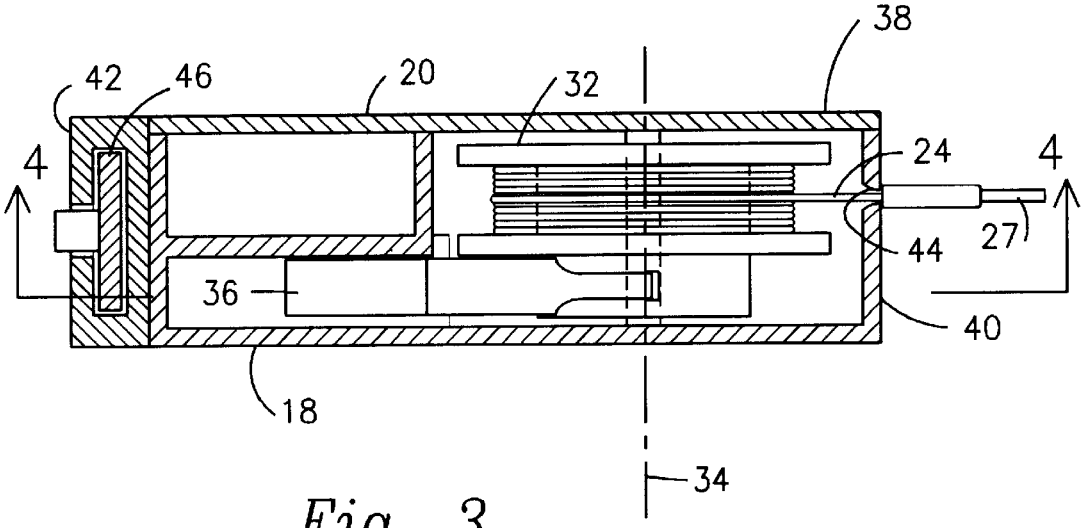
FIG. 3 is a sectional view of the base of FIG. 2 taken along lines 3—3.
Figure 4:
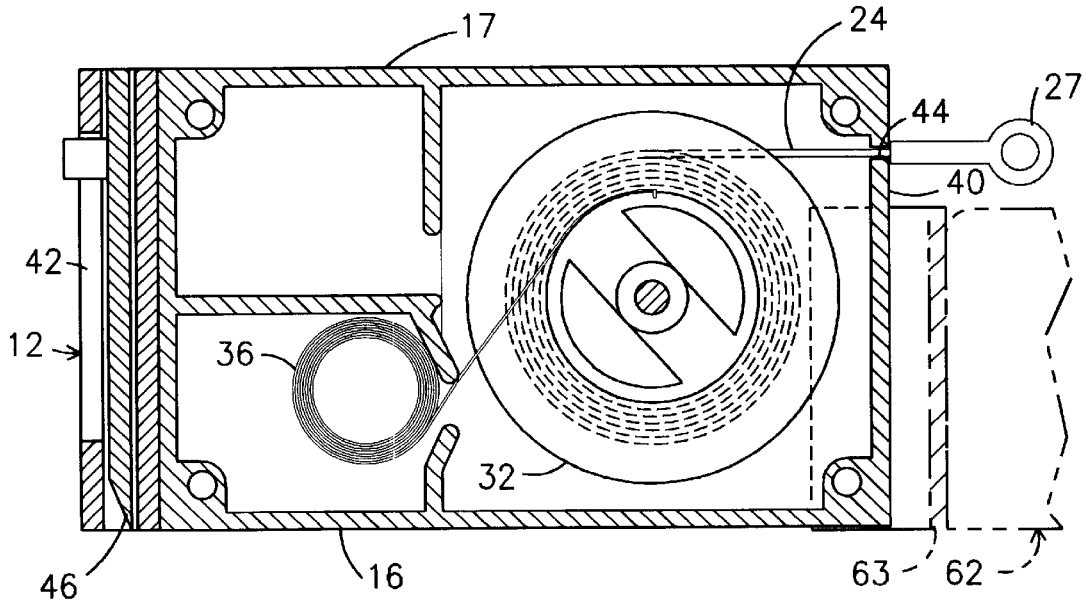
FIG. 4 is a sectional view of the base of FIG. 3 taken along lines 4—4.

Referring to FIGS. 2–4, the preferred embodiment of the base 12 includes an enclosure 38 in which a bias element 22 is positioned. Such enclosure 38 may suitably include the bottom portion 16, a top portion 17, a pair of generally opposed side wall portions 18 and 20 extending upwardly from the bottom portion 16. In addition, the enclosure also includes generally opposed front and rear wall portions 40 and 42, respectively, extending upwardly from the bottom portion 16 generally transverse to the pair of side walls 18 and 20. While the preferred enclosure 38 illustrated in the figures is shaped generally like a box, it will be understood by those skilled in the art that substantially any shape enclosure may suffice. Preferably, the front wall 40 of the enclosure 38 includes an aperture 44 formed therethrough, through which at least a portion of the length of a connecting element 24 may traverse as the attachment assembly 30 is moved with respect to the bias element 22.

A preferred embodiment of enclosure 38 also includes a stake 46 that may extend generally downwardly from the bottom portion 16 of the base 12, and which may suitably be positioned proximal the rear wall 42 of the enclosure 38. The stake 46 may conveniently be connected to the putting surface 14, such as being inserted into surface 14, such as putting green, or otherwise grip the surface, to resist movement of generally parallel to the surface 14. To aid the user, the base is suitably positioned proximal to a hole or other target. Thus, an individual may freely swing the putter 13 having the attachment assembly 30 appropriately attached thereto both toward and away from base 12 over the varying distances, with the connecting element 24 providing a substantially linear visual alignment reference to the target along which the individual may guide the putter 13. In that the apparatus 10 of the present invention is suitably adapted for indoor and for outdoor use, such stake 46 preferably is retractable with respect to the bottom portion 16 of the enclosure 38.

Alternatively, or in addition to having stake 46, the base and bias element may be sufficiently weighted to resist sliding movement generally parallel to surface 14 when positioned thereupon. The weight required to achieve this results will largely depend upon the amount of tension being provide to connecting element 24 by bias element 22. As stated herein, the preferred embodiment of the apparatus of the present invention utilizes a bias element that provides substantially little tension to connecting element, as too much tension will interfere with the putting stroke and act as a hindrance rather than assist the golfer with his or her putting stroke, which is a primary purpose of the present invention. The tension need only enable connecting element 24 to provide a substantially linear visual reference for the user. Upon selecting the appropriate amount of tension, the combined weight of the base 12, which may be formed of a thermoplastic resin material, metal or other rigid material, and the bias element 22 connected thereto will suitably provide sufficient weight to maintain the fixed position of base 12 with respect to the surface 14 as the attachment assembly is moved toward and away from base 12. In addition, the apparatus preferably is sufficiently light weight and compact so that golfers easily are able to carry the apparatus 10 with them, suitably in their golf bags.

In order to provide for an improved putting stroke, a first end 26 of the connecting element 24 is connected to the bias element 22 and a second end 28 of the connecting element 24, which may be a simple loop of the connecting element 24, is connected to a putter attachment assembly, generally indicated as 30, with the attachment assembly being moveable away from the bias element 22 a varying distance up to the length of the connecting element 24. The connecting element 24, which may suitably be a substantially light weight and flaccid string or cord 25, is maintained taut by the bias element 22 to generally provide a visual linear alignment reference along the direction towards the target to which the golfer is putting. Such cord 25 may suitably contain distinct markings as to indicate the distance between the attachment assembly and the enclosure 38.

The amount of tension provided by the bias element 22 maintains the length of the connecting element 24 that extends between the attachment assembly 30 and the bias element 22 taut. Preferably, the tension is minimal and unobtrusive to a golfer in that an individual golfer does not perceive a significant amount of resistance at the putter 13 to which the attachment assembly 30 is attached as it may be moved a varying distance apart from the bias element 22. Thus, the force exerted by bias element should be less than the frictional forces between the base bottom 16 and the putting surface. In addition, while the stake 46 of the enclosure 38 may be inserted into a putting surface 14 to provide for increased stability, it preferably is not necessitated by the relatively small amount of tension provided by the bias element 22 to the connecting element 24.

Referring to the preferred embodiment of FIGS. 3–4, the bias element 22 preferably includes a spool 32 having a longitudinal axis of rotation, indicated as 34. The spool 32 is preferably rotably mounted to at least one of the side walls 18 or 20 of the base 12, with the first end 26 of the connecting element 24 being attached to the spool 32. In addition, the bias element 22 preferably includes a spring 36, suitably attached to the spool 32, to provide tension to the length of the connecting element 24 extending between the attachment assembly 30 and the spool 32. The tension provided from the spring 32 to the connecting element 24 preferably remains substantially constant as the attachment assembly 30 is moved with respect to the bias element 22 over a varying distance defined by the length of the connecting element 24. In addition, it is preferable that the spool 32 be attached to the spring 36 such that the spring 36 biases the spool 32 to rotate about its axis 34 and wind the connecting element 24 around the spool 32, similar to conventional retractable tape measures retracting a length of measuring tape. In this manner, substantially constant tension is transferred generally from the spring 36, suitably a constant torque coil spring, to the length of the connecting element 24 that extends between the attachment assembly 30 and the spool 32. In addition, the amount of torque provided by the spring 36 may vary by including an adjustable torque control coupled to the spring 36.

Figure 5:
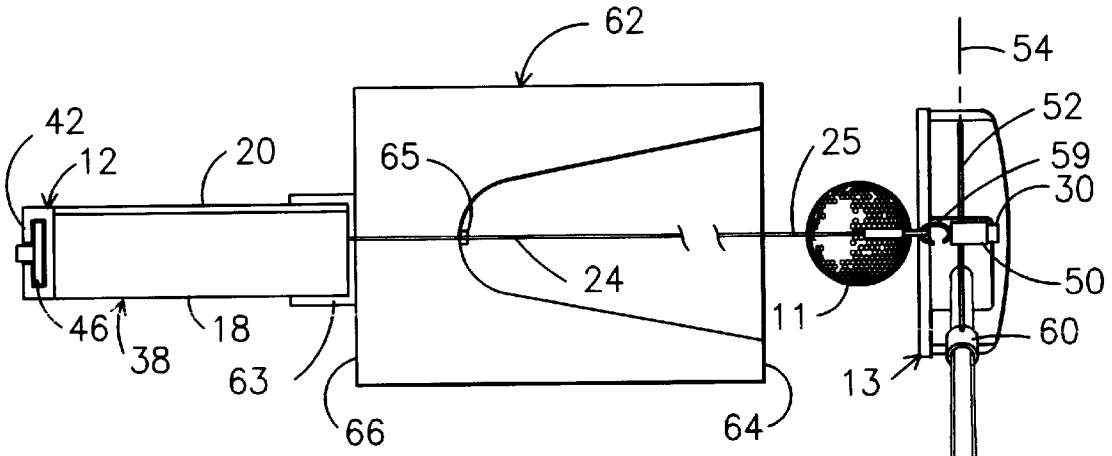
FIG. 5 is a top view of an alternative preferred embodiment of the apparatus of the present invention attached to a ball return device.
Figure 6:
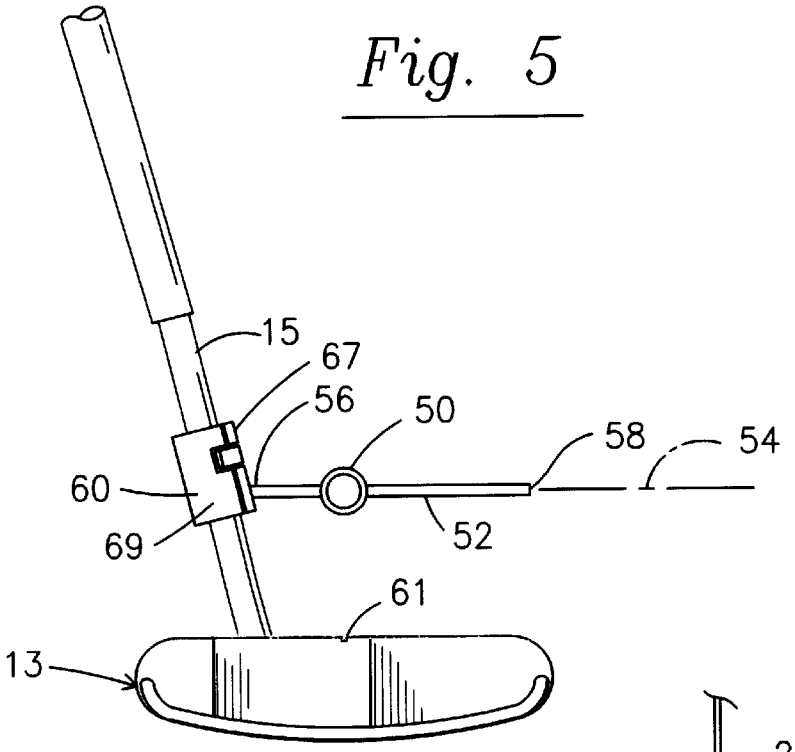
FIG. 6 is an enlarged fragmentary view of the attachment assembly of the apparatus of FIG. 5.
Figure 7:
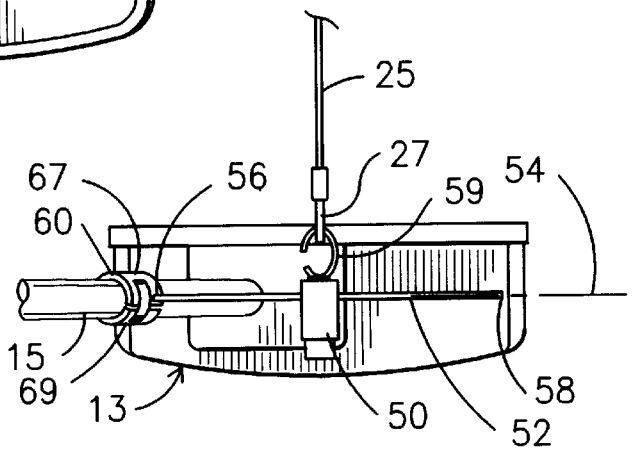
FIG. 7 is top view of the attachment assembly of FIG. 6.

As shown in FIGS. 1 and 5, the attachment assembly 30 preferably is releasably attachable to the shaft 15 of the putter 13 in order to assist a golfer to move the putter 13 over a generally linear path defined by the connecting element 24, suitably centered over a golf ball 11, toward a target. Referring to FIGS. 6 and 7, the attachment assembly 30 of the present invention provides an effective means to train an individual to align the "sweet-spot" 61 of the putter 13 with the center of the golf ball 11 as well as provide an appropriate visible reference along which the individual may guide "sweet-spot" 61 of the putter 13 during a putting stroke. The attachment assembly 30 preferably includes an alignment marker 50 that is connected, suitably by positioning the loop 27 over a hook 59 fixed to the alignment marker 50, to the second end 28 of the connecting element 24. Of course, any conventional connection between the connecting element 24 and the alignment marker 50 may suffice.

The alignment marker 50 is preferably adjustably mounted to an elongated, substantially rigid member 52 having a longitudinal axis 54 and two ends 56 and 58, such that the alignment marker 50 may move along the rigid member 52 generally parallel to the axis 54. The adjustability of the alignment marker 50 along the rigid member 52, which may suitably be a resilient metallic rod or the like, enables the apparatus 10 of the present invention to accommodate substantially all sizes and styles of putters. In addition, the attachment assembly 30 also preferably includes a releasable clamp 60 attached generally adjacent to one end 56 or 58 of the rigid member 52. The releasable clamp 60 may suitably include two generally opposed and arcuate jaws 67 and 69 dimensioned and configured for receiving the shaft of a putter 13 to provide for the releasable attachment to the shaft 15 of the putter 13, suitably proximal the head of the putter 13.

One of the preferred implementations of the present invention for indoor use includes employing the apparatus 10 of the present invention in conjunction with a conventional ball return device 62, such as, for example, model no. AML589 manufactured by Automatic Company, Ltd. Referring to FIG. 5, an alternative preferred embodiment of the present invention is shown to include the conventional ball return device 62 having a front portion 64 with a target 65 and a rear portion 66, suitably dimensioned and configured for attachment to the base. In the preferred embodiment illustrated in FIGS. 4 and 5, the enclosure 38 includes a ball return attachment element 63 positioned at the front wall portion 40. The attachment element provides for the removable attachment of the enclosure to the rear portion 66 of the ball return device 62. Preferably, the attachment is such that the connecting element 24, illustrated as the cord 25, extending between the attachment assembly 30 and the bias element 22 remains aligned generally linearly with the target 65 of the ball return device 62 as the attachment assembly 30, suitably attached to a putter 13, is moved a varying distance with respect to the enclosure 38 and the ball return device 62.

In view of the foregoing detailed description of the preferred embodiment of the present invention, it is evident that the apparatus 10 of the present invention provides an effective alignment apparatus for putting. Thus, an individual may position the base 12 of the apparatus 10 at a desired location on a putting surface 14, which may suitably be indoor or outdoor, by inserting the stake 46 into the turf, attaching the enclosure 38 to a ball return device 62 or simply positioning the enclosure 38 on the surface 14. An individual then may approach a golf ball 11 spaced apart from the base 12 and position the putter having the attachment assembly appropriately attached thereto behind the ball 11 with the connecting element 24 positioned over the center of the golf ball 11. This establishes a substantially linear alignment between the "sweet-spot" 61 of the putter 13, the center of the golf ball 11 and the target, which may conveniently be a hole 48 or the target 65 of a mechanical ball return device 62 as well as any other would be target. Preferably, the target is positioned proximal the enclosure 38 of the base 12 of the apparatus 10. By maintaining such alignment during the complete putting stroke, an individual may improve his putting stroke by properly following through with the putter as well as keeping their head down and their eye on the ball 11 during the stroke.

It will thus be seen that the objects set forth above, among those made apparent from the proceeding description, are efficiently attained, and, since certain changes may be made in carrying out the construction of the apparatus set forth without departing from the scope of the present invention, it is intended that all matter contained in the above description or shown in the accompanying drawings shall be interpreted as illustrative and not in a limiting since. Accordingly, because numerous variations and modifications of this invention, all within the scope of the invention, will readily occur to those skilled in the art, the scope of the invention is to be limited solely by the claims appended hereto.

What is claimed is:

1. A golf putting practice apparatus primarily intended to train a golfer to move a putter linearly for putting a golf ball positioned on a surface toward a target, said apparatus comprising:

a base having a bottom portion engageable with the putting surface for resisting movement of said base generally parallel to the putting surface;

a bias element attached to said base;

an elongated flexible connecting element having a predetermined length and two ends, a first end of said connecting element connected to said bias element, such that said bias element provides tension to said connecting element; and a putter attachment assembly comprising an elongated, substantially rigid member, having a longitudinal axis and two ends, and an alignment marker adjustably mounted to said rigid member and attached to said second end of said connecting element, such that said alignment marker may move along said rigid member generally parallel to said axis of said rigid member, said attachment assembly being releasably attachable to a putter, with said attachment assembly being movable a varying distance toward and away from said bias element generally up to said length of said connecting element, with the tension from said bias element maintaining the portion of said connecting element extending between said attachment assembly and said base taut and substantially linear as said attachment assembly is moved said varying distance, whereby the base maintains a substantially fixed position with respect to the surface when the base is positioned upon the surface as the attachment assembly is moved the varying distance.

2. An apparatus as claimed in claim 1, wherein said bias element provides a substantially constant amount of tension to said portion of said connecting element extending between said attachment assembly and said bias element as said attachment assembly is moved said varying distance.

3. A golf putting practice apparatus primarily intended to train a golfer to move a putter linearly for putting a golf ball positioned on a surface toward a target, said apparatus comprising:

a base having a bottom portion engageable with the putting surface for resisting movement of said base generally parallel to the putting surface, a bias element attached to said base;

an elongated flexible connecting element having a predetermined length and two ends, a first end of said connecting element connected to said bias element, such that said bias element provides tension to said connecting element; and a putter attachment assembly connected to a second end of said connecting element, said attachment assembly being releasably attachable to a putter, with said attachment assembly being movable a varying distance toward and away from said bias element generally up to said length of said connecting element, with said tension from said bias element maintaining the portion of said connecting element extending between said attachment assembly and said base taut and substantially linear as said attachment assembly is moved said varying distance, whereby the base maintains a substantially fixed position with respect to the surface when said base is positioned upon the surface as the attachment assembly is moved the varying distance; and a golf ball return device comprising a front portion having a target and a rear portion dimensioned and configured for attachment to said base.

4. An apparatus as claimed in claim 3, wherein said bias element provides a substantially constant amount of tension to said portion of said connecting element extending between said attachment assembly and said bias element as said attachment assembly is moved said varying distance.

5. A golf putting practice apparatus comprising:

an enclosure having a bottom portion, a pair of generally opposed side wall portions extending upwardly from said bottom portion, and generally opposed front and rear wall portions extending upwardly from said bottom portion generally transverse to said pair of side walls;

a stake extending generally downwardly from said bottom portion of said enclosure, said stake being connectable to a putting surface:

a bias element mounted within said enclosure:

an elongated flexible connecting element having a predetermined length and two ends, a first end of said connecting element connected to said bias element such that said bias element provides tension to said connecting element; and a putter attachment assembly connected to a second end of said connecting element, said attachment assembly being releasably attachable to a putter, with said attachment assembly being movable a varying distance toward and away from said bias element generally up to said length of said connecting element, with said tension from said bias element maintaining the portion of said connecting element extending between said attachment assembly and said bias element taut as said attachment assembly is moved said varying distance.

6. A golf putting practice apparatus as claimed in claim 5 wherein said stake is retractable with respect to said bottom portion of said enclosure.

7. An apparatus as claimed in claim 5, wherein said bias element provides a substantially constant amount of tension to said portion of said connecting element extending between said attachment assembly and said bias element as said attachment assembly is moved said varying distance.

8. A golf putting practice apparatus primarily intended to train a golfer to move a putter linearly for putting a golf ball positioned upon a putting surface toward a target, said apparatus comprising:

a base having a bottom portion engageable with the putting surface for resisting movement generally parallel to the putting surface;

a bias element attached to said base;

an elongated flexible connecting element having a predetermined length and two ends, a first end of said connecting element connected to said bias element such that said bias element provides tension to said connecting element; and a putter attachment assembly connected to a second end of said connecting element, said attachment assembly being releasably attachable to a putter, said attachment assembly comprising an elongated, substantially rigid member having a longitudinal axis and two ends, said alignment marker adjustably mounted to said rigid member such that said alignment marker may move along said rigid member generally parallel to said axis of said rigid member, with said attachment assembly being movable a varying distance toward and away from said bias element generally up to the length of said connecting element, with said tension from said bias element maintaining the portion of said connecting element extending between said attachment assembly and said bias element taut.

9. A golf putting practice apparatus as in claim 8 wherein said bias element provides a substantially constant amount of tension to said portion of said connecting element extending between said attachment assembly and said bias element as said attachment assembly is moved said varying distance.

10. A golf putting practice apparatus as claimed in claim 8 wherein said attachment assembly further comprises a releasable clamp attached generally adjacent to one said end of said rigid member, said clamp being releasably attachable to a putter shaft.

11. A golf putting practice apparatus as claimed in claim 8 wherein said releasable clamp comprises two generally opposed and arcuate jaws dimensioned and configured for receiving an elongated shaft.

12. A golf putting practice apparatus primarily intended to train a golfer to move a putter linearly for putting a golf ball positioned upon a putting surface toward a target, said apparatus comprising:

a base having a bottom portion engageable with the putting surface for resisting movement generally parallel to the putting surface;

a bias element attached to said base;

an elongated flexible connecting element having a predetermined length and two ends, a first end of said connecting element attached to said bias element such that said bias element provides tension to said connecting element;

a putter attachment assembly connected to a second end of said connecting element, said attachment assembly being releasably attachable to a putter, with said attachment assembly being movable toward and away from said bias element a varying distance up to the length of said connecting element, with said tension from said bias element maintaining the length of said connecting element extending between said attachment assembly and said bias element taut; and a golf ball return device comprising a front portion that defines the target, said return device having a rear portion dimensioned and configured for attachment to said base, said base being attached to said return device.

13. A golf putting practice apparatus as in claim 12 wherein said bias element provides a substantially constant amount of tension to said portion of said connecting element extending between said attachment assembly and said bias element as said attachment assembly is moved said varying distance.

14. A golf putting practice apparatus as claimed in claim 13 wherein said base is removably attached to said rear portion of said ball return device such that said connecting element extending between said attachment assembly and said bias element aligns generally linearly with said target as the attachment assembly is moved said varying distance.

15. A golf putting practice apparatus as claimed in claim 14 wherein said base further comprises an enclosure having a bottom portion, a pair of generally opposed side wall portions extending upwardly from said bottom portion, and generally opposed front and rear wall portions extending upwardly from said bottom portion generally transverse to said pair of side walls, with an aperture being formed through said front wall portion of said enclosure through which said connecting element may traverse, said bias element being mounted within said enclosure, and said aperture of said front wall portion positioned proximal to said target of said ball return device, whereby the taut length of the connecting element extending between the attachment assembly and the enclosure is aligned generally linearly with the target as the attachment assembly is moved the varying distance.

* * * * *